US007091805B2

(12) United States Patent
Kawahara et al.

(10) Patent No.: US 7,091,805 B2
(45) Date of Patent: Aug. 15, 2006

(54) ELECTROMAGNETIC RELAY

(75) Inventors: Kuniaki Kawahara, Nishimatsuura-gun (JP); Shinya Matsuo, Karatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/054,738

(22) Filed: Feb. 9, 2005

(65) Prior Publication Data

US 2005/0200439 A1 Sep. 15, 2005

(30) Foreign Application Priority Data

Mar. 15, 2004 (JP) ..... 2004-073210

(51) Int. Cl.
*H01H 67/02* (2006.01)

(52) U.S. Cl. ..... 335/132; 335/130
(58) Field of Classification Search ..... 335/78–86, 335/129–132, 202; 200/243, 247
See application file for complete search history.

(56) References Cited

U.S. PATENT DOCUMENTS 3,260,824 A 7/1966 Schleicher
3,740,510 A * 6/1973 Grunert ..... 200/289
4,405,848 A * 9/1983 Jaegle ..... 200/243
4,594,484 A * 6/1986 Lemmer ..... 200/16 A
4,931,757 A * 6/1990 Lemmer et al. ..... 335/131
5,021,760 A 6/1991 Krubsack et al.
5,075,660 A * 12/1991 Ootsuka ..... 335/131
5,081,436 A * 1/1992 Nishi et al. ..... 335/83
5,815,058 A * 9/1998 Gizaw ..... 335/132

FOREIGN PATENT DOCUMENTS

DE 2315567 A1 10/1974

OTHER PUBLICATIONS

European Search Report for application No. 05002182.3-1231, dated Jul. 4, 2005.

* cited by examiner

*Primary Examiner*—Lincoln Donovan
(74) *Attorney, Agent, or Firm*—Beyer Weaver & Thomas LLP

(57) ABSTRACT

An electromagnetic relay has a mobile contact point attached to a contact member, a fixed contact point, a contact point spring that applies a biasing force on the contact member towards the fixed contact point, a guide that carries the contact member and said contact point spring, a coil that generates a pulling force when excited to move the guide and a returning spring that provides a biasing force for causing the guide to return. A mechanism is provided such that a load is generated on the contact member by the motion of the guide towards the fixed function against the returning spring immediately before the mobile contact point contacts the fixed contact point. This mechanism applies a contact point spring load of the contact point spring and the load as a contact pressure to the contact member for contacting the mobile contact point with the fixed contact point.

8 Claims, 14 Drawing Sheets

ELECTROMAGNETIC RELAY

Priority is claimed on Japanese Patent Application 2004-073210 filed Mar. 15, 2004.

BACKGROUND OF THE INVENTION

This invention relates to an electromagnetic relay usable as a high-capacity power relay and in particular to such a relay having contact points with an improved contact mechanism.

As shown in FIGS. 23–26, a prior art electromagnetic relay is comprised of an operating part 101 and a contact point block 102, the operating part 101 having an electromagnetic block 105 with a coil 105A and an iron member 106 contained inside a case 104 such that an attractive force is generated at the magnetic pole part 107 of the iron core as the coil 105A is excited and the iron member 106 is oscillated to the left around its supporting point 106A.

The contact point block 102 is formed with a base 108, a guide 109, a terminal table 110 and a returning spring 111. As shown in FIG. 25A, the terminal table 110 is provided with a guide containing part 118 and contact point containing parts 120, each contact point containing part 120 containing a fixed contact point 121. The guide 109 is separable into an upper main body 109A and a lower main body 109B, as shown in FIG. 24. The upper main body 109A has an upward protrusion 112 at its left-hand end, and the lower main body 109B has a downward protrusion 113 at its right-hand end. A spring container 112A is formed at the base of the upward protrusion 112, and the downward protrusion 113 is formed with an indentation for engagement (not shown).

Four insertion parts 114 are formed longitudinally along the upper guide main body 109A. As shown in FIG. 25A, a spring container 114A is formed at an end part of each of the insertion parts 114 and mobile contact points 116 are affixed to both end parts on the left-hand surface (on the side facing the fixed contact points 121) of a contact member 115.

The spring container 114A of each insertion part 114 contains a contact point spring 117 which contacts a corresponding one of the contact members 115 such that each contact member 115 is pressed to the left-hand wall part of the insertion part 114 by the biasing force of the contact point spring 117, as shown by broken lines in FIG. 25B. Both end parts of the contact member 115 are inside the corresponding one of the contact point containing parts 120 and the mobile contact points 116 are opposite the fixed contact points 121.

The guide 109 is contained inside the guide containing part 118 with its upward protrusion 112 inserted into an opening (not shown) formed in the ceiling part of the guide containing part 118 and its downward protrusion 113 inserted into an insertion opening 108A provided through the base 108. The guide 109 is normally at its returned position as shown in FIG. 25A by the biasing force of the returning spring 111.

The electromagnetic relay is formed with this contact point block 102 connected to the operating part 101. In this condition, a protrusion 106B at the top of the iron member 106 is oscillatingly engaged in the aforementioned indentation formed in the downward protrusion 113 from the lower guide main body 109B.

When the coil 105A of the electromagnetic block 105 is not in an excited condition, the guide 109 is in the aforementioned returned position by the biasing force of the returning spring 111. As the coil 105A of the electromagnetic block 105 is excited, an attractive force is generated to magnetic pole part 107 of the iron core and the iron member 106 is caused to oscillate to the left around its supporting point 106A such that the guild 109 is shifted against the biasing force of the returning spring 111 and the mobile contact points 116 are caused to contact the fixed contact points 121.

As another example of prior art electromagnetic relay, Japanese Patent Publication Koho 5-342964 described a structure comprising an electromagnet part, a contact point table, an insulating plate and a case. A base is formed with the contact point table and the insulating plate, a guide being slidably inserted into a groove formed at the center of the base. A fixed terminal of contact point terminals is set inside each of a plurality of chambers provided at fixed intervals opposite on both sides of this groove, and mobile contact points of contact members protruding sideways at equal intervals from both sides of the groove and being biased by means of springs are disposed opposite the fixed terminals. As the coil of the electromagnet part is excited and a mobile iron member is rotated, the guide is moved against the biasing force of a returning spring and the mobile contact points are pressed against the fixed contact points.

With both of these prior art electromagnetic relays, the contacting mechanism gains a pressure by means of the guide 109, the contact member 115 and the contact point spring 117. With such a mechanism as shown in FIG. 25B, it is necessary to increase the load on the contact point spring 117 to obtain a contact point pressure by limiting the separation of the mobile contact points 116 at the time of contact point contact (bouncing and chattering) and the rise in temperature by the passage of the current. For this purpose, since the characteristic of a relay is as schematically shown by the graph of FIG. 26, it is necessary to increase the attractive force of the coil from A to B and this means an increase in the consumption of electric power. In order to limit the increase in the power consumption by the coil 105A, however, the load on the contact point spring 117 must be limited and this can cause problems related to the separation of the contact member 115 due to vibrations and generation of heat.

SUMMARY OF THE INVENTION

It is therefore an object of this invention in view of the above to provide an improved electromagnetic relay capable of securing a sufficient contact point pressure without increasing the load on the contact point spring (that is, without increasing the power consumption by the coil).

An electromagnetic relay according to this invention may be characterized as comprising a contact member having a mobile contact point, a fixed contact point, a contact point spring that applies a biasing force on the contact member towards the fixed contact point, a guide that carries the contact member and the contact point spring, a coil that generates a pulling force when excited to move the guide, a returning spring that provides a biasing force and thereby causes the guide to return, and a load generating mechanism that generates a load on the contact member by a motion of the guide towards the fixed function against the returning spring immediately before the mobile contact point contacts the fixed contact point, wherein the load generating mechanism applies a contact point spring load of the contact point spring and the load as a contact pressure to the contact member for pressing the mobile contact point onto the fixed contact point.

In the above, the load generating mechanism may comprise a supplementary member having elastic planer members each folded twice on both ends so as to have a generally U-shaped cross-sectional configuration, the supplementary member being attached to the contact member, the guide having protruding contact parts that cause the aforementioned folded U-shaped elastic members to be deformed to thereby generate the required load by contacting it as the guide is moved.

As another example, the load generating mechanism may comprise elastically deformable planar members that may be gradually curving or have folded end parts and are attached to the guide, being adapted to become deformed and to thereby generate the load by contacting the contact member as the guide is moved.

It is preferable that these supplementary members be made of a metallic material so as to have a large heat conductivity. If they are made of a metal such as copper, they can effective radiate away heat from the contact members

DETAILED DESCRIPTION OF THE INVENTION

Figure 2:
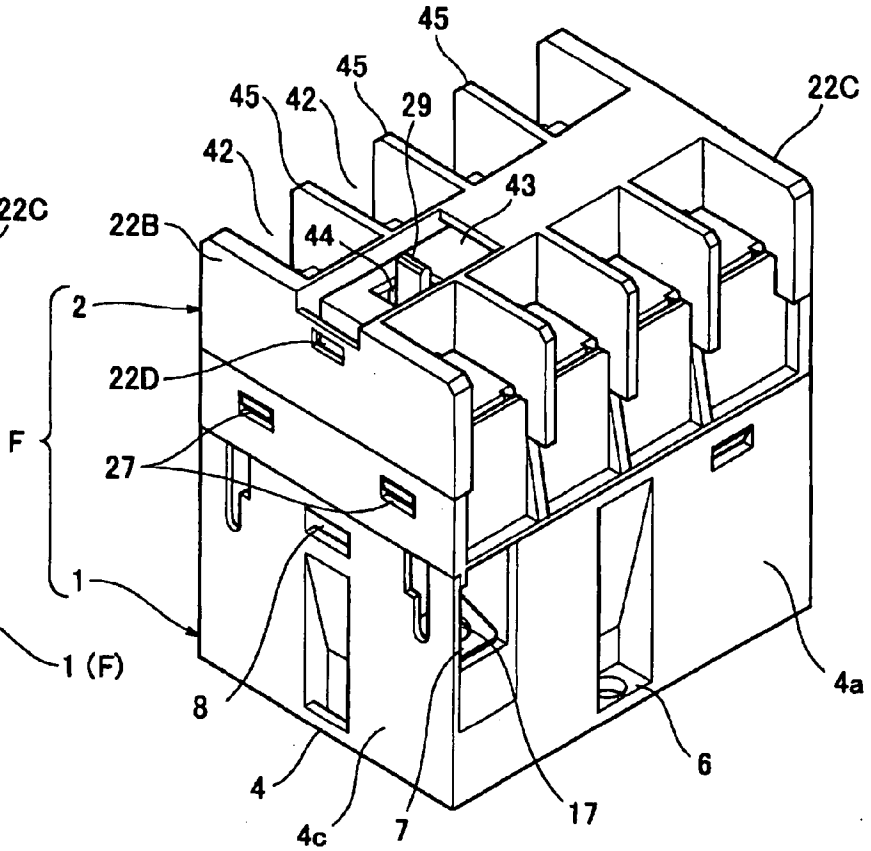
FIG. 2 is a diagonal view of its main body.
Figure 1:
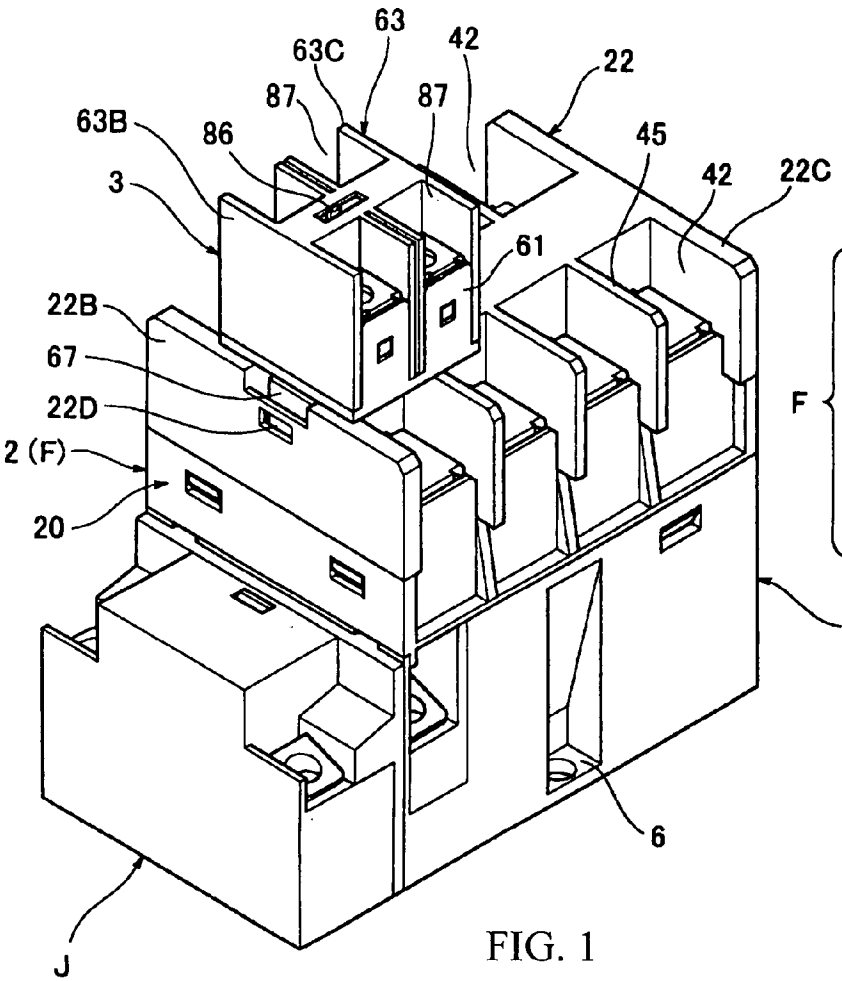
FIG. 1 is a diagonal view of an electromagnetic relay embodying this invention.
Figure 4:
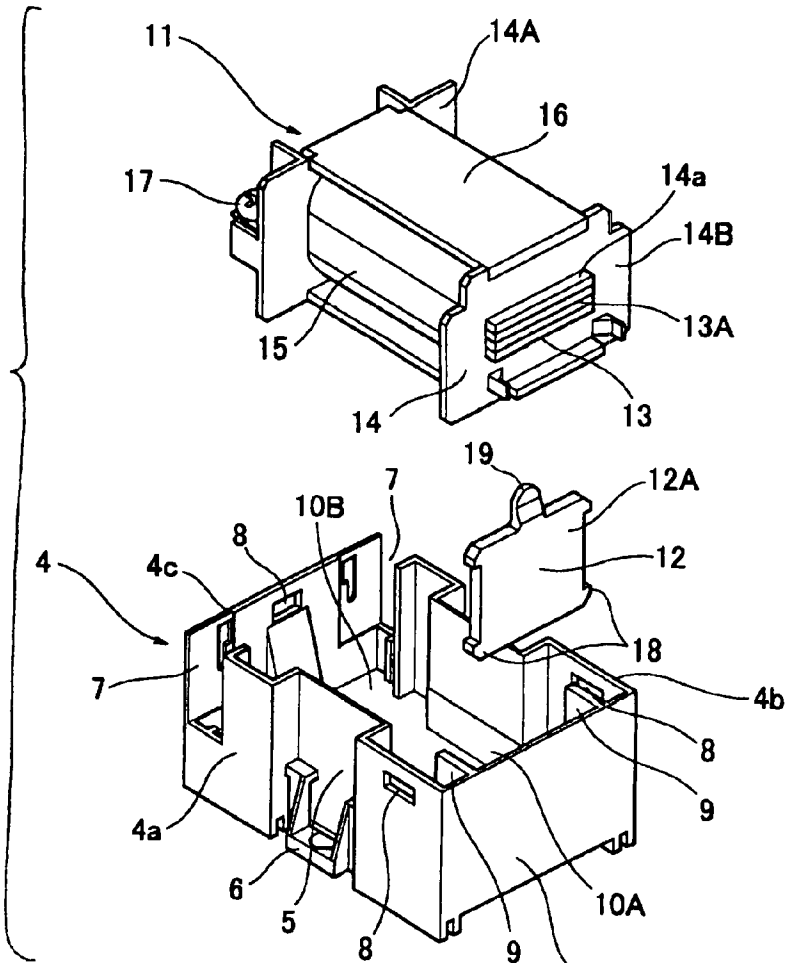
FIG. 4 is an exploded diagonal view of its electromagnetic block.
Figure 3:
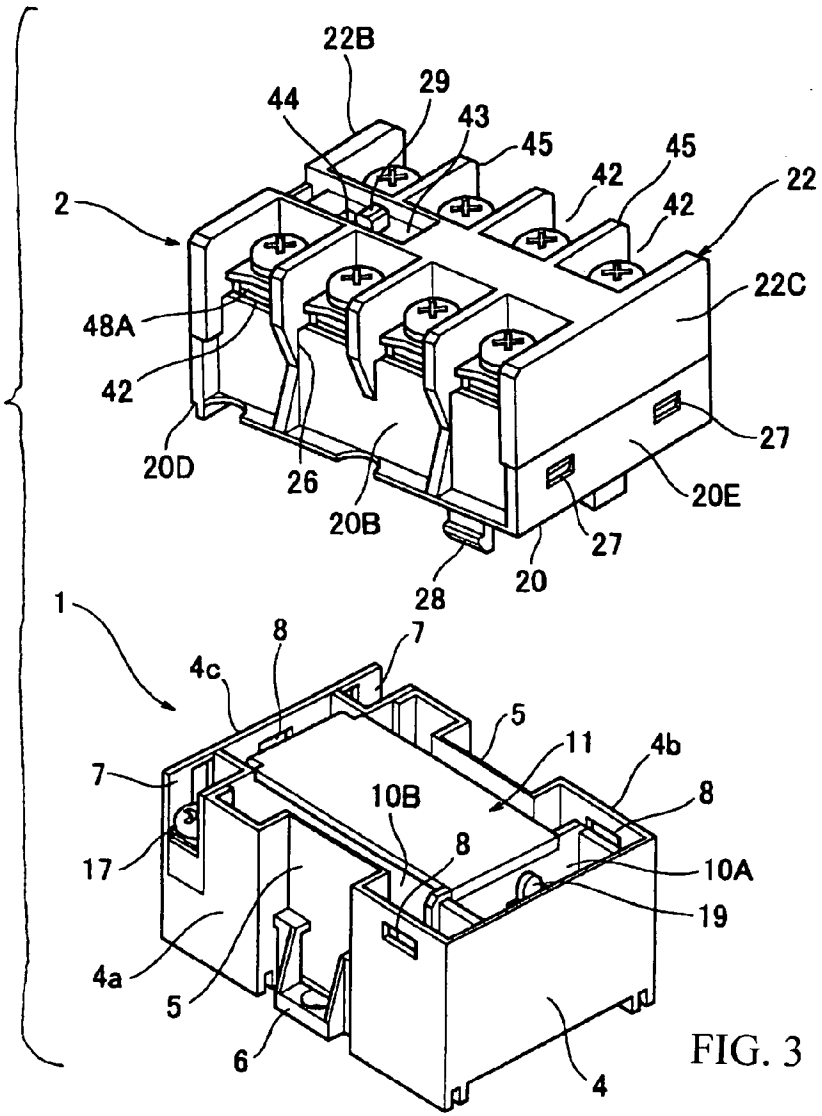
FIG. 3 is an exploded diagonal view of the main body.
Figure 5:
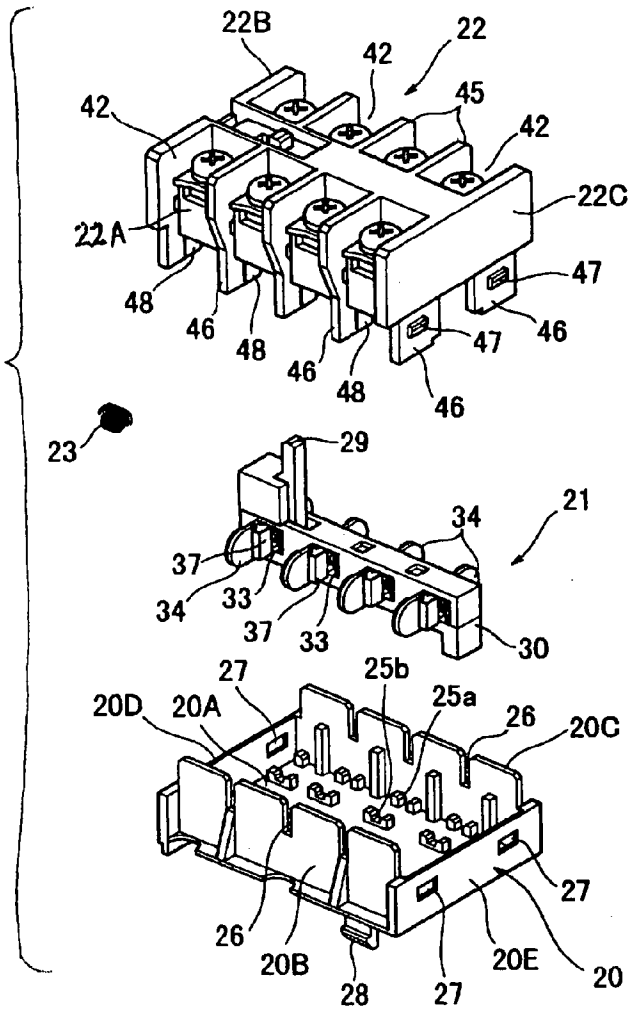
FIG. 5 is an exploded diagonal view of its contact point block.

The invention is described with reference to an example with reference to FIGS. 1–22. FIG. 1 is a diagonal view of an electromagnetic relay embodying this invention. FIG. 2 is a diagonal view of its main body. FIG. 3 is an exploded diagonal view of the main body. FIG. 4 is an exploded diagonal view of its electromagnetic block. FIG. 5 is an exploded diagonal view of its contact point block.

As shown in FIG. 1, an electromagnetic relay embodying this invention may be described as comprising an electromagnetic operating part 1, a contact point block 2 and a supplementary contact point block 3 in an integrated form, the electromagnetic operating part 1 and the contact point block 2 together forming a relay main body F. Letter J in FIG. 1 indicates an AC operating unit removably attached to the relay main body F.

As shown in FIGS. 3 and 4, the electromagnetic operating part 1 is provided with a case 4, an electromagnetic block 11 and an iron member 12. Shorter side wall parts 4*a* and 4*b* of the case 4 have each an indentation 5 formed in the longitudinal direction in a middle portion, and an attachment seat 6 is provided at a lower portion of this indentation 5. The side wall parts 4*a* and 4*b* are each provided with a window part 7 on the left-hand side (with reference to FIG. 4).

An opening 8 for engagement is also provided to each of the side wall parts 4*a* and 4*b* and also one of the end walls 4*c* which are facing mutually opposite in the longitudinal direction of the case 4. A pair of partition walls 9 is formed on the inner surface of the other of the end walls 4*d*, sandwiching therebetween an iron member containing part 10A. The interior of the case 4 exclusive of this iron member containing part 10A serves as an electromagnetic block containing part 10B. A supporting part (not shown) for the iron member 12 is provided at the bottom of the iron member containing part 10A.

The electromagnetic block 11 includes a spool 14 having a central hole 14*a* and flanges 14A and 14B at both ends. A coil 15 is wound around this spool 14 and an iron core 13 penetrates the central hole 14*a*. The right-hand end of this iron core 13 is formed as a magnetic pole part 13A.

A yoke 16 is provided to the spool 14. The yoke 16 has a bent end part which is affixed to the left-hand end part (not shown) of the iron core 13. Coil terminals 17 are provided to the flange 14A.

As shown in FIG. 4, the iron member 12 includes a main body 12A with a rectangular shape having supporting point parts 18 on its side edges. A protrusion 19 for engagement is formed at the center of the top edge of this main body 12A.

As shown in FIG. 3, the electromagnetic block containing part 10B of the case 4 contains the electromagnetic block 11 and the iron member containing part 10A contains the iron member 12. This is done with the coil terminals 17 of the electromagnetic block 11 inserted into the window parts 7 of the case 4 and the supporting points 18 of the iron member 12 supporting the supporting parts of the iron member containing part 10A oscillatingly. The iron member 12 faces opposite the magnetic pole part 13A of the iron core 13 of the electromagnetic block 11.

As shown in FIGS. 3 and 5, the contact point block 2 is comprised of a base 20, a guide 21, a block main body 22 with a terminal table 22A and a returning spring 23.

Figure 6:
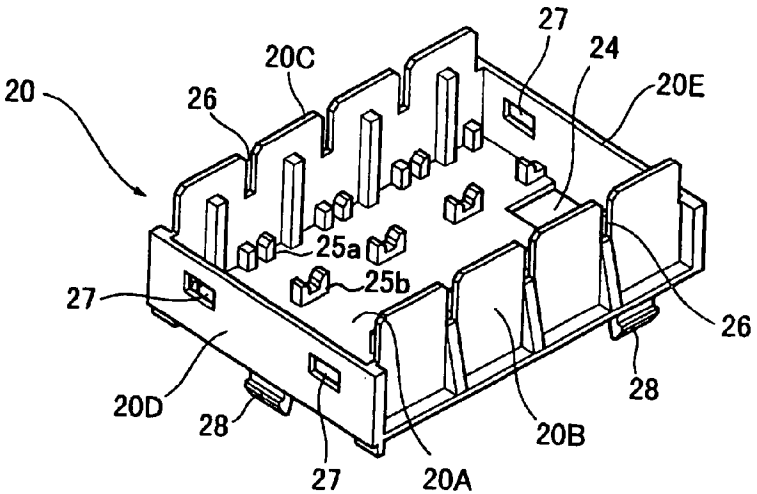
FIG. 6 is a diagonal view of the base of the contact point block.

As shown in FIGS. 5 and 6, the base 20 has a rectangular bottom surface part 20A, front and back side wall parts 20B and 20C on the shorter-length sides of the base 20 and end wall parts 20D and 20E on the longer-length sides of the base 20. As shown in FIG. 6, the bottom surface part 20A has an opening 24 on the side of the end wall part 20E. Pairs of leg receiving parts 25*a* and 25*b* are formed in rows on the bottom surface part 20A in the longitudinal direction. As shown further in FIG. 6, a plurality of grooves 26 for engagement are formed on the side wall parts 20D and 20E at fixed intervals, and a pair of openings 27 is formed through each of the end wall surfaces 20D and 20E. A hook part 28 for engagement is also formed to the bottom surface part 20A of the base 20 on both end parts in the longitudinal direction.

Figure 7:
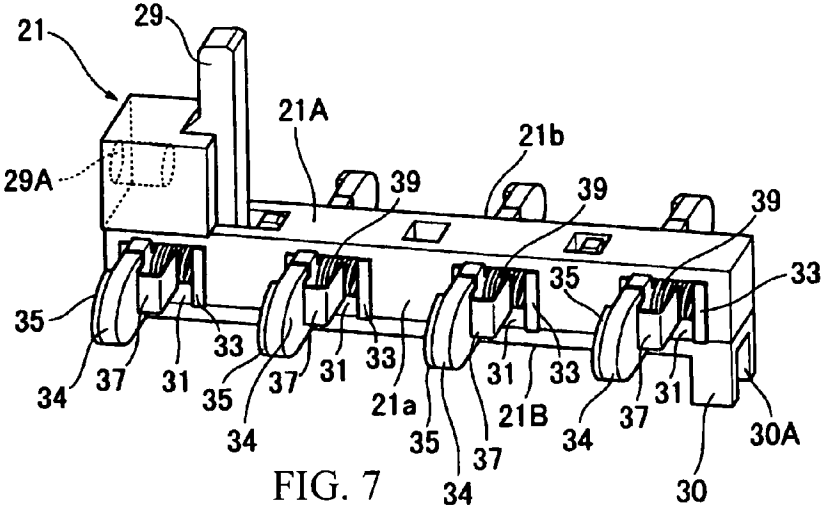
FIG. 7 is a diagonal view of the guide of the contact point block.

As shown in FIG. 7, the guide 21 is separable into an upper main body 21A and a lower main body 21B. The upper main body 21A has an upward protrusion 29 at the left-hand end, and a spring containing part 29A is formed at the base of this upward protrusion 29. The lower main body 21B has a downward protrusion 30 at the right-hand end, and an indentation 30A for engagement is formed on this downward protrusion 30.

Figure 9:
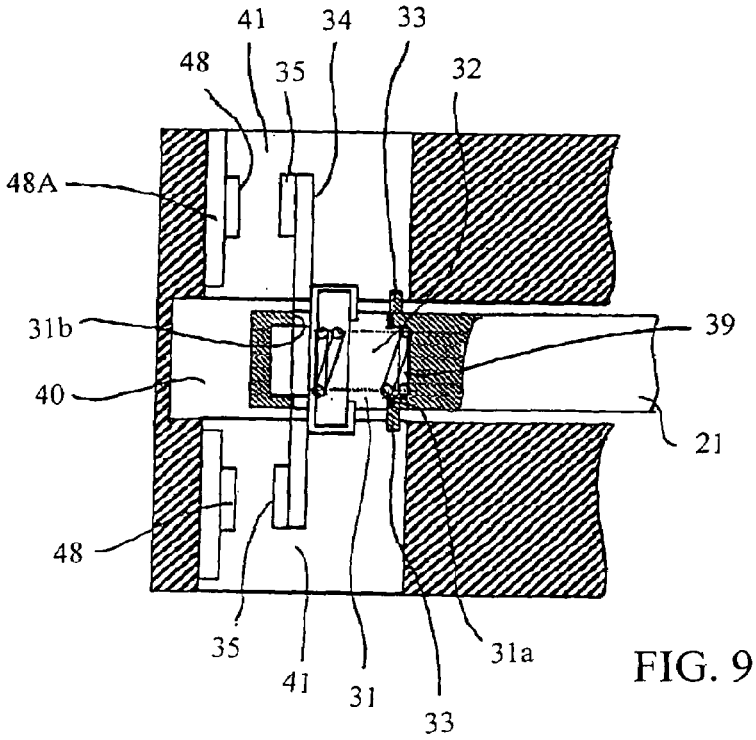
FIG. 9 is a sectional view of a portion of the guide for showing its returned condition.

Four rectangular inserting parts 31 are formed through the upper main body 31A from one of its side surfaces 21*a* to the other side surface 21*b*, arranged in the longitudinal direction. As shown in FIG. 9, a spring containing part 32 is formed on the right-hand end surface 31*a* of each inserting part 31. A protruding contact part 33 with a flat end surface for an improved contact capability is on each of side surfaces 21*a* and 21*b* on the side of the right-hand end surface 31*a* of the inserting part 31.

Figure 8:
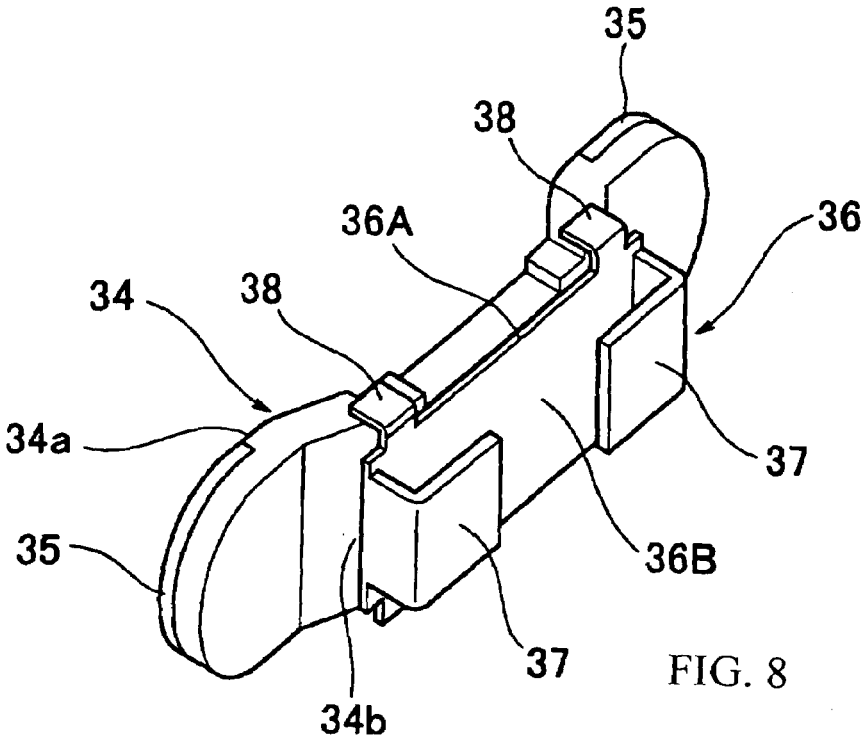
FIG. 8 is a diagonal view of the contact member.

As shown in FIG. 8, a contact member 34 is formed with mobile contact points 35 attached at both end parts on its front surface 34*a* (on the side of the fixed contact point to be described below) and a supplementary member 36 attached on the back surface 34*b* (opposite the front surface 34*a*).

The supplementary member 36 attached to the back of the contact member 34 is made of an elongated elastic material 36*a* with its both end parts folded twice each by 90° so as to be sectionally U-shaped. These end parts will be hereinafter referred to as folded end parts 37. In addition, a pair of bent protrusions 38 are formed to this supplementary member 36 for engagement. The supplementary member 36 thus structured is attached to the back surface 34*b* of the contact member 34 by engaging the aforementioned downward protrusion 30 to both side edge portions of the contact member 34. The center part of the supplementary member 36 serves as a spring contact part 36B.

The contact member 34 is inserted into the rectangular inserting part 31 as shown in FIG. 9 and the spring containing part 32 contains a contact point spring 39 which contacts the aforementioned spring contact part 36B of the supplementary member 36 such that the contact member 34 is biased by the contact point spring 39 to press on a left-hand end surface 31*b* of the inserting part 31. The guide 21, the contact member 34 supported by the guide 21, the mobile contact points 35, the contact point spring 39, the protruding contact part 33 and the fixed contact points 48 (to be described below) are hereinafter referred to as comprising a contact mechanism.

Figure 10:
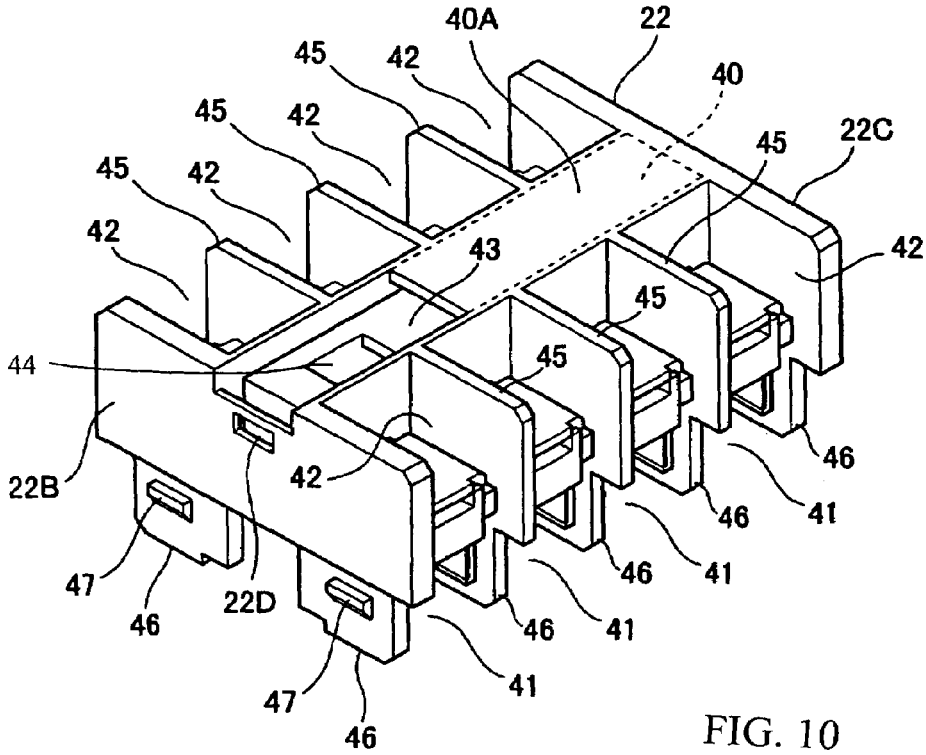
FIG. 10 is a diagonal view of the terminal table of the contact point block.

As shown in FIG. 10, the block main body 22 has end wall parts 22B and 22C formed in its longitudinal direction and a guide containing part 40 and contact point containing parts 41 formed between the end wall parts 22B and 22C, and the terminal table 22A has a plurality of terminal setting parts 42 formed on both sides sandwiching the guide containing part 40.

The guide containing part 40 has a ceiling 40A with a rectangular indentation 43 near the end wall part 22B and a rectangular opening is formed at the bottom of this indentation 43. The end wall part 22B has an opening 22D therethrough, leading into this indentation 43.

The terminal setting parts 42 are formed by means of a plurality of partition walls 45 between the end wall parts 22B and 22C. The end wall parts 22B and 22C and the partition walls 45 extend downward to serve as legs 46, and the areas formed between these legs 46 are the aforementioned contact point containing parts 41 on both sides of the guide containing part 40. The legs 46 of the end wall parts 22B and 22C each have a hook part 47 for engagement.

As shown in FIGS. 5 and 9, each of the contact point containing parts 41 contains the fixed contact point 48 of a fixed terminal 48A which is inside the terminal setting part 42.

The guide 21 and the block main body 22 are inside the base 20, and the legs on both sides of the guide containing part 40 of the block main body 22 are positioned by means of the leg receiving parts 25*a* and 25*b*. The partition walls 45 of the block main body 22 are engaged in the grooves 26 on the side wall parts 20B and 20C, and the hook parts 47 of the block main body 22 engage with the openings 27 of the base 20.

Figure 11A:
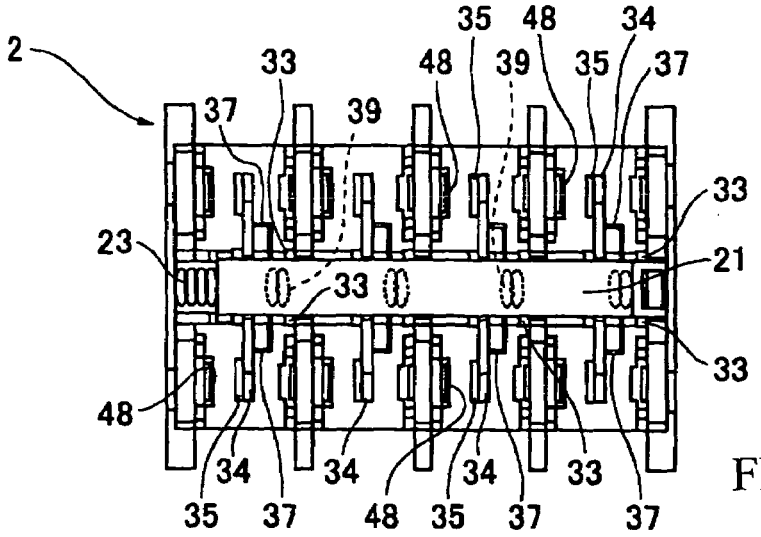
FIGS. 11A, 11B and 11C, together referred to as FIG. 11, are schematic diagrams for showing the operation of the electromagnetic relay main body.

In this condition, the guide 21 is movably contained inside the guide containing part 40 of the block main body 22 with the upward protrusion 29 inserted into an opening 44 of the guide containing part 40 and the downward protrusion 30 inserted into the opening 24 of the base 20. The returning spring 23 is contained inside the spring containing part 29A of the upward protrusion 29 and the guide 21 is at its returned position as shown in FIG. 11A by means of the biasing force of this returning spring 23. In other words, the guide 21 is at the position with stroke zero in this returned position, and each contact member 34 is pressed to the end surface 31*b* of the inserting part 31 by means of the biasing force of the corresponding contact point spring 39. The mobile contact points 35 on the contact member 34 are separated from the fixed contact points 48, and the folded end parts 37 of the supplementary member 36 are separated from the protruding contact parts 33.

The relay main body F is formed by connecting the contact point block 2 thus structured as above with the electromagnetic operating part 1. This connection is effected by engaging the hook parts 28 on the bottom surface part 20A of the base 20 removably with the openings 8 in the case 4. When the contact point block 2 is thus connected to the electromagnetic operating part 1, the protrusion 19 on the top edge of the iron member 12 engages oscillatingly with the indentation 30A on the downward protrusion 30 protruding from the opening 24 of the base 20. The folded end parts 37 of the supplementary member 36 and the protruding contact parts 33 are herein said to form the load generating means.

Figure 14:
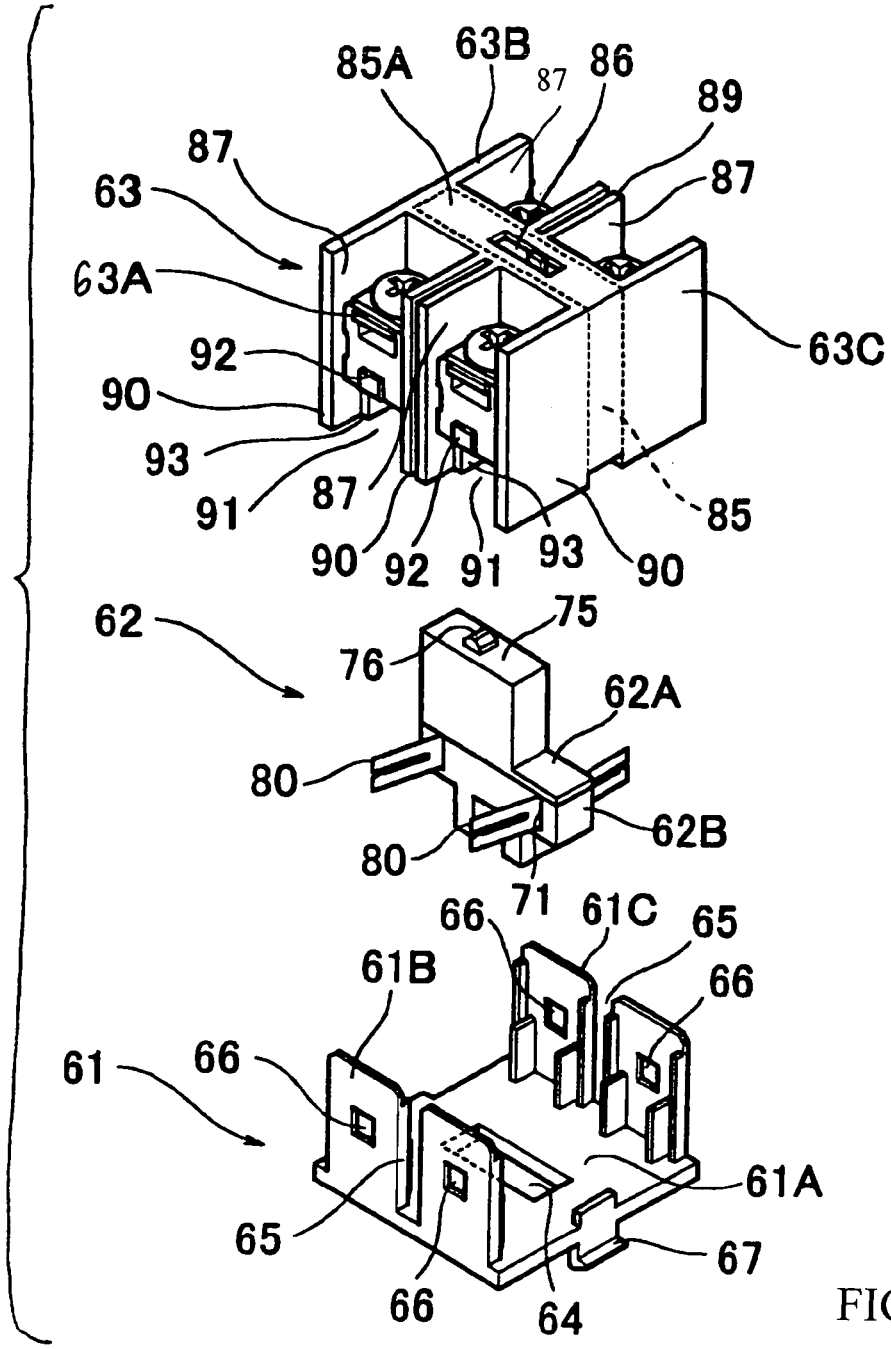
FIG. 14 is an exploded diagonal view of the supplementary contact point block.

As shown in FIGS. 13–19, the supplementary contact point block 3 comprises a base 61, a guide 62 and a block main body 63 having a terminal table 63A. The base 61 has a rectangular bottom surface part 61A and a side wall parts 611B and 61C in the direction of its shorter side. As shown in FIG. 14, an opening 64 for insertion is formed at the center of the bottom surface part 61A. A groove 65 and openings 66 are formed through each of the side wall parts 61B and 61C for engagement. A hook part 67 for engagement is formed on an edge in the longitudinal direction of the base 61.

Figure 15:
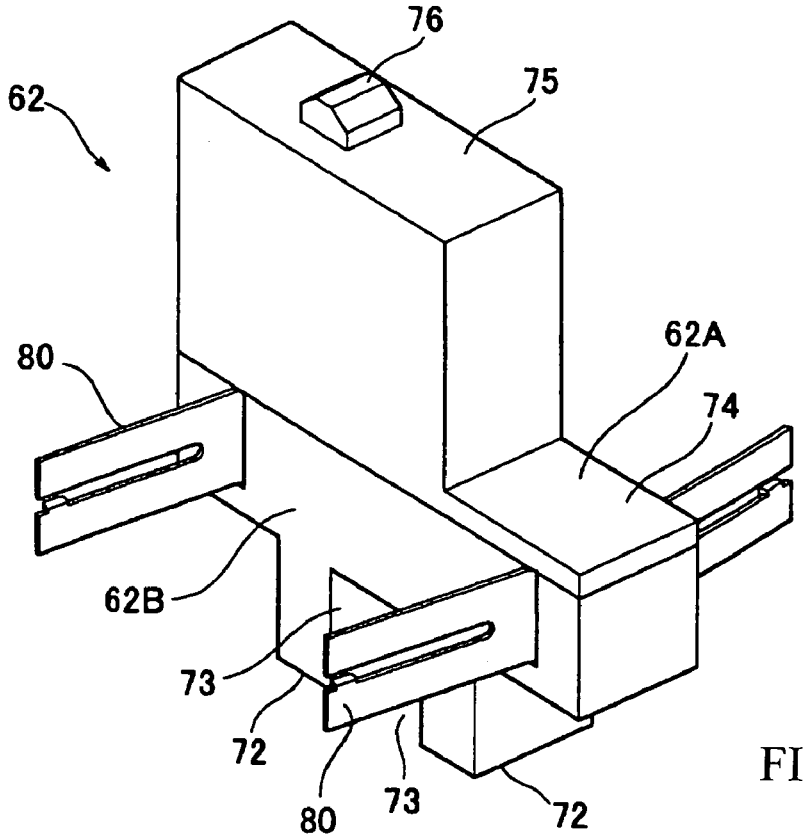
FIG. 15 is a diagonal view of the guide of the supplementary contact point block.
Figure 16:
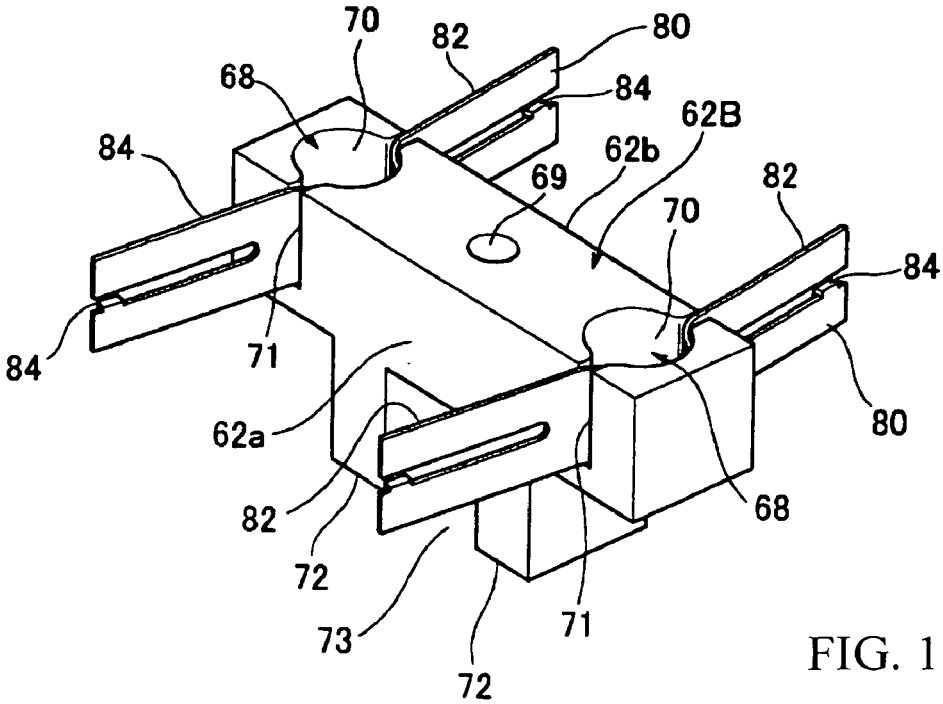
FIG. 16 is a diagonal view of the lower guide main body.

As shown in FIG. 15, the guide 62 is separable into an upper guide body 62A and a lower guide body 62B. The upper main guide body 62A has a base part 74 which fits with the upper surface part of the lower guide body 62B and a guide part 75 that protrudes upward therefrom. A handle 76 is formed at the top of the guide part 75. The base part 74 is provided with a pin (not shown) for engagement.

The lower guide body 62B is provided with two setting parts 68 in the longitudinal direction on its upper surface and a pin hole 69 at the center of the upper surface. Each of these setting parts 68 has an opening 70 and notches 71 connecting the peripheral surface of the opening 70 with both side surface parts 62*a* and 62*b*. A pair of leg parts 72 protrudes downward from the bottom surface of the lower guide body 62B, defining therebetween an inserting part 73.

Figure 17:
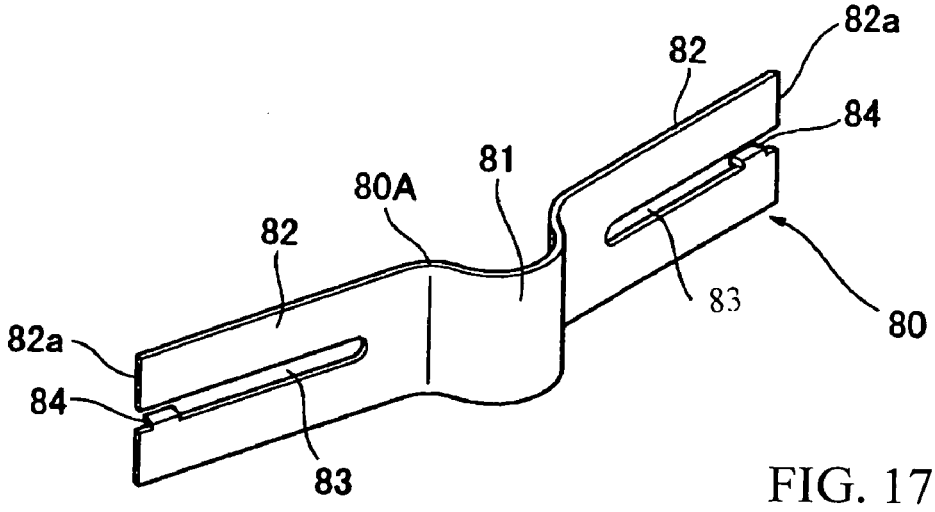
FIG. 17 is a diagonal view of the contact member of the supplementary contact point block.

A contact member 80 is set to each of the setting parts 68 of the lower guide body 62B. As shown in FIG. 17, the contact member 80 of the supplementary contact point block 3 is made of an elongated main body 80A of an elastic material with its center part bent in a semicircular form to provide an engaging part 81 and a notch 83 formed in each of the elastic member parts 82 on both sides of this engaging part 81 from its edge part 82*a* extending towards the engaging part 81. A mobile contact point 84 is attached to the tip of each of the elastic member parts 82.

Figure 18:
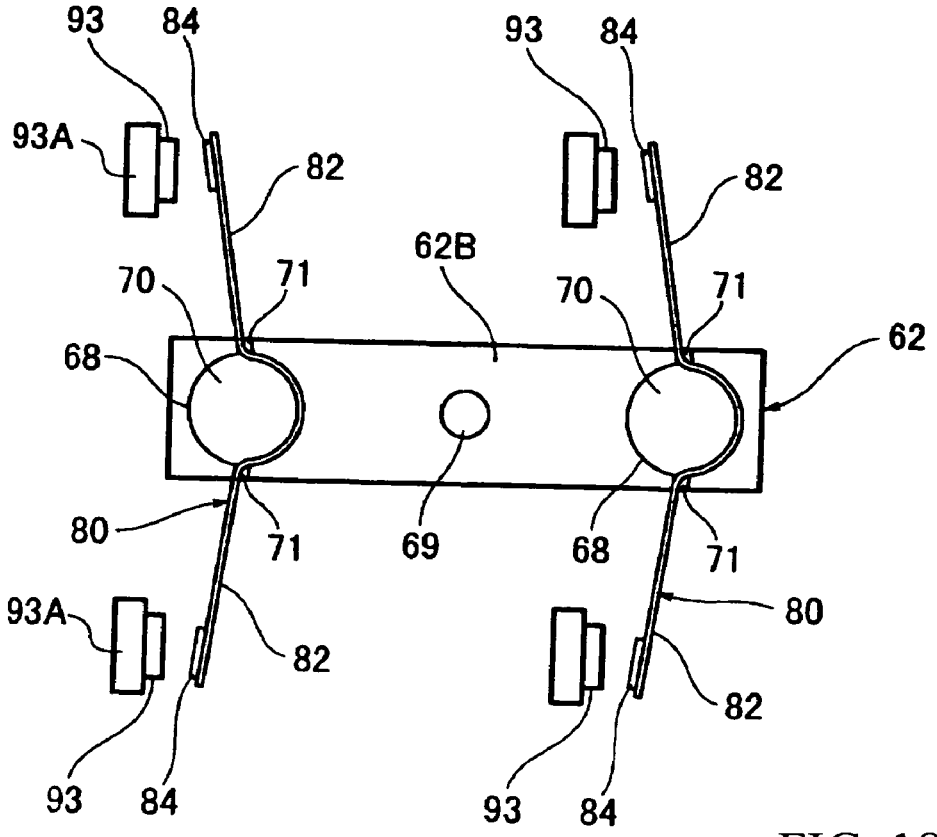
FIG. 18 is a diagram for showing the distribution of the mobile and fixed contact points of the guide.

As shown in FIG. 18, the contact member 80 this structured is set to each of the setting parts 68 by engaging its engaging part 81 to the opening 70 and inserting the base parts of the elastic member parts 82 into the notches 71. The pin on the upper main guide body 62A is engaged in the pin hole 69 on the upper surface of the lower main guide body 62B, and the guide 62 is formed by matching the upper and lower main guide bodies 62A and 62B.

As shown in FIG. 14, the block main body 63 has end wall parts 63B and 63C, and a guide containing part 85 with a ceiling part 85A is formed between these end wall parts 63B and 63C. A rectangular opening 86 is formed at the center of this ceiling part 85A. A plurality of terminal setting parts 87, separated by partition walls 89, are formed on both sides of the guide containing part 85.

These end wall parts 63B and 63C and the partition walls 89 extend downward to provide downward protrusions 90, and terminal setting parts 91 are defined between them. These terminal setting parts 91 are on both sides of the guide containing part 85 and a hook part 92 for engagement is provided on the bottom outer surface of each of the terminal setting parts 87.

Each terminal setting part 91 contains a fixed contact point 93 of a fixed terminal 93A. The fixed terminal 93A is contained in the terminal setting part 87. The block main body 63 is attached to the base 61 by engaging the hook part 92 to the opening 66 with the guide 62 contained inside its guide containing part 85. The handle 76 on the guide part 75 is inserted into the opening 86 of the guide containing part 85. The leg parts 72 from the lower guide body 62B are inserted into the opening 64 and extend out of the base 61.

The electromagnetic relay is formed with the supplementary contact point block 3 thus structured being connected to the relay main body F. This connection is effected by engaging the hook part 67 of the base 61 into the opening 22D of the block main body 22 of the relay main body F. In this case, the leg parts 72 of the guide 62 are inserted into the opening 44 at the bottom of the indentation 43 of the contact point block 2, and the upward protrusion 29 of the guide 21 of the contact point block 2 is inserted into the inserting part 73 between the leg parts 72 of the guide 62.

Thus, if the guide 21 is in the returned condition with the supplementary contact point block 3 in the condition of being connected to the relay main body F, the guide 62 of the supplementary contact point block 3 is also in the returned condition and, as shown in FIG. 18, the mobile contact point 84 of each contact member 80 is separated from the corresponding fixed contact point 93.

Next, the operation of the electromagnetic relay thus structured will be explained.

When the coil 15 of the electromagnetic block 11 is not excited, the guide 21 in at its returned position as shown in FIG. 11A due to the biasing force (the returning spring load) F1 of the returning spring 23. As the coil 15 is excited, a pulling force F is generated at the magnetic pole part 13A of the iron core 13 and the iron member 12 is attracted and is caused to oscillate around its supporting point 18.

Figure 11B:
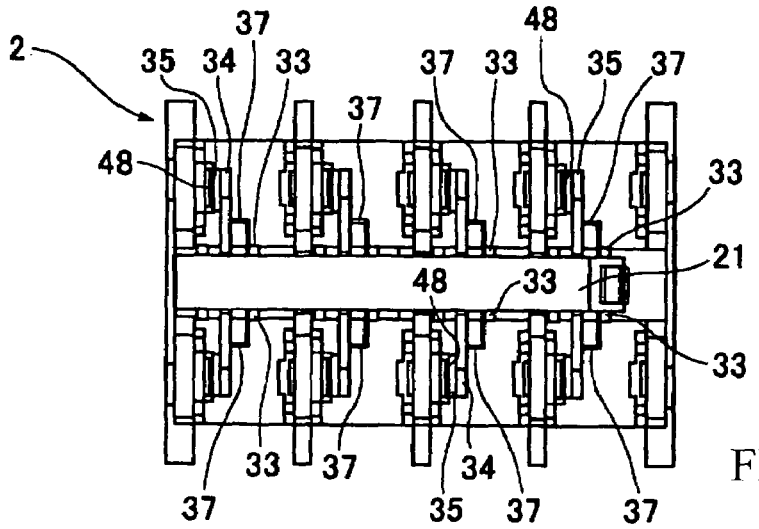

As the iron member 12 oscillates, the protrusion 19 at the top of the iron member 12 causes the guide 21 through the downward protrusion 30 to move as shown in FIG. 11B against the returning spring 23 such that the folded end parts 37 of the supplementary member 36 come to contact the protruding contact part 33. This is indicated in the graph of FIG. 12 as the time of adsorption, and the contact point spring load F2 operates on the contact member 34.

Figure 11C:
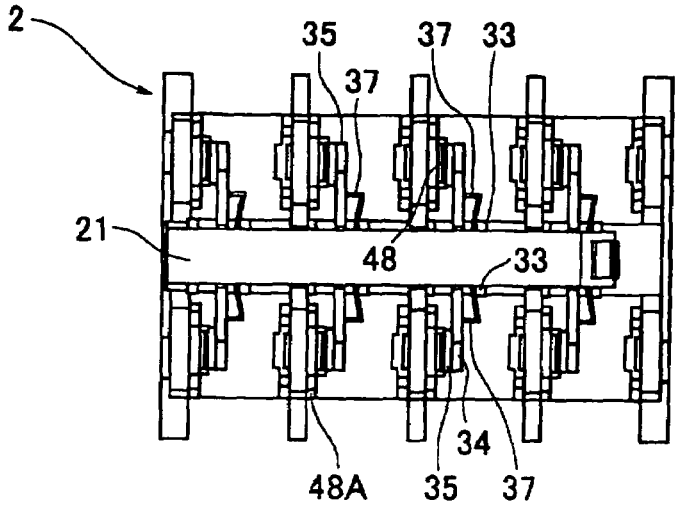
Figure 12:
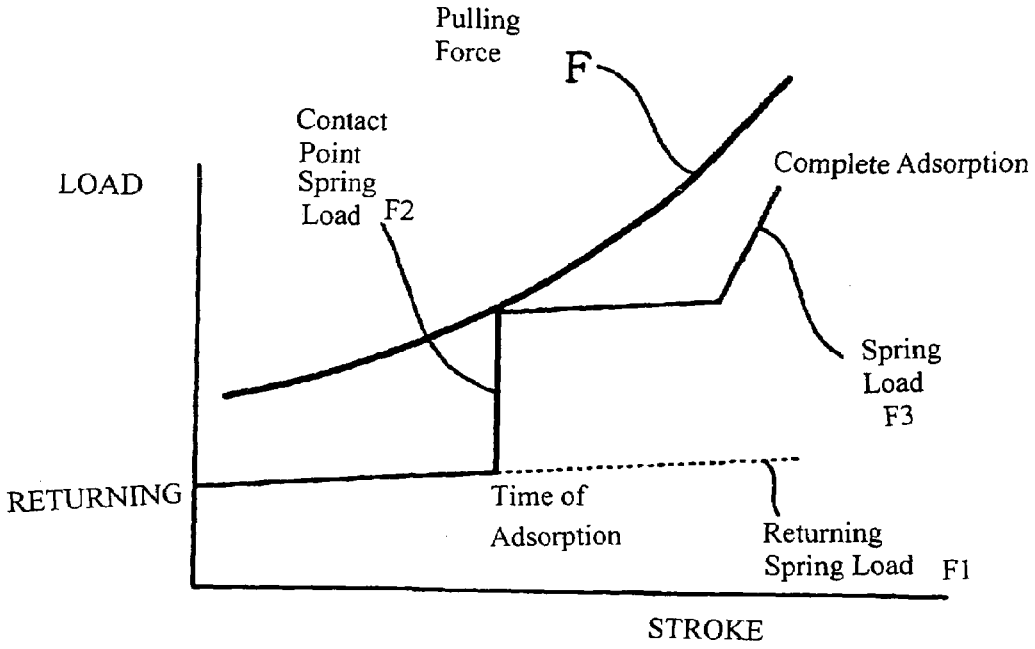
FIG. 12 a schematic graph showing the characteristic of the relay main body.
Figure 13:
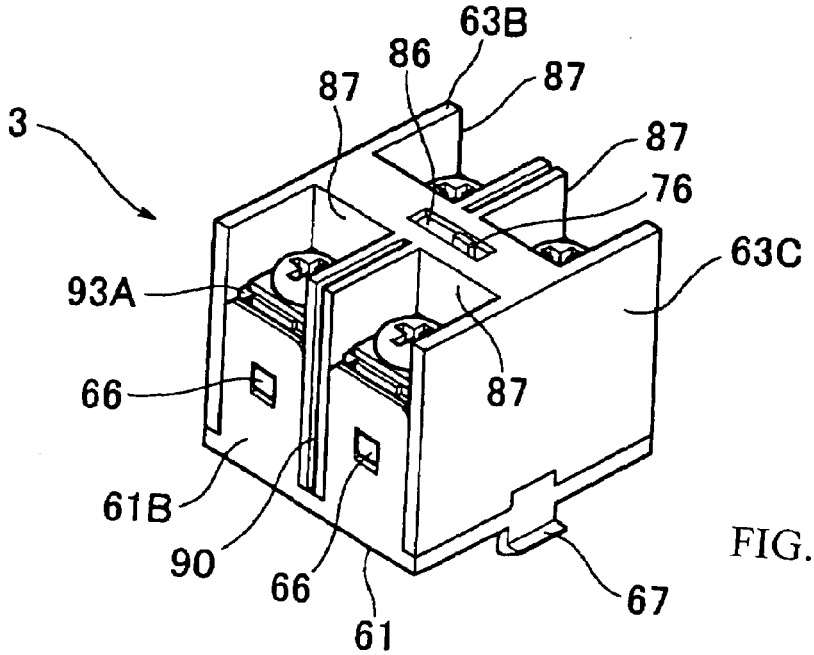
FIG. 13 is a diagonal view of the supplementary contact point block.

As shown in FIG. 12, the pulling force F increases with the stroke. As the pulling force F increases, the guide 21 is further pushed through the iron member 12 and hence the folded end parts 37 of the supplementary member 36 become deformed by the protruding contact part 33, as shown in FIG. 11*c*, thereby generating a load (spring load) F3 in the folded end parts 37. At this moment of complete adsorption, a contact point pressure due both to the aforementioned contact point spring load F2 and to the spring load F3 generated in the folded end parts 37 of the supplementary member 36 operates on the contact member 34 and the mobile contact points 35 are pressed against the fixed contact points 48.

Thus, both the contact point spring load F2 and the spring load F3 generated to the folded end parts 37 of the supplementary member 36 operate as the contact point pressure under the condition of complete adsorption. In this situation, since the spring load F3 of the supplementary member 36 is generated immediately before the mobile contact points 31 become completely adsorbed to the fixed contact points 40, there is no need to obtain the contact point pressure by increasing the load on the contact point spring (by increasing the power consumption by the coil). In other words, a required contact point pressure can be obtained without increasing the pulling power of the coil 15.

As the coil 15 is de-excited to remove its pulling power, the guide 21 moves by the returning force F1 of the returning spring 23, returning to the returned position shown in FIG. 11A. Since the contact member 34 is held by the supplementary member 36 during this time of return, the separating time of the mobile contact points 35 can be reduced. If the supplementary member 36 is made of a metallic material such as copper, heat can be irradiated more efficiently from the heated contact points.

Figure 19A:
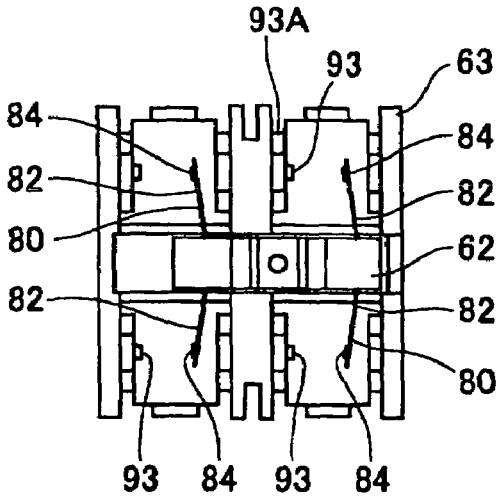
FIGS. 19A, 19B and 19C, together referred to as FIG. 19, are schematic diagrams for showing the operation of the supplementary contact point block.
Figure 19B:
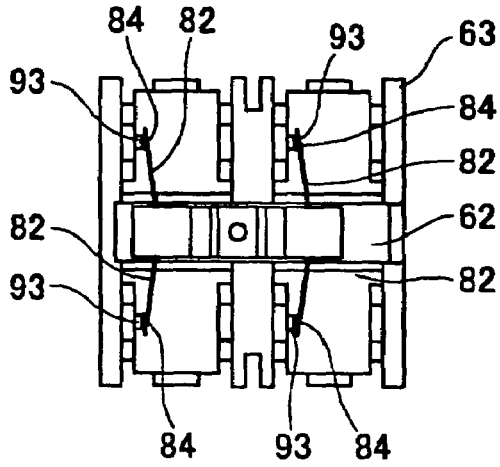
Figure 19C:
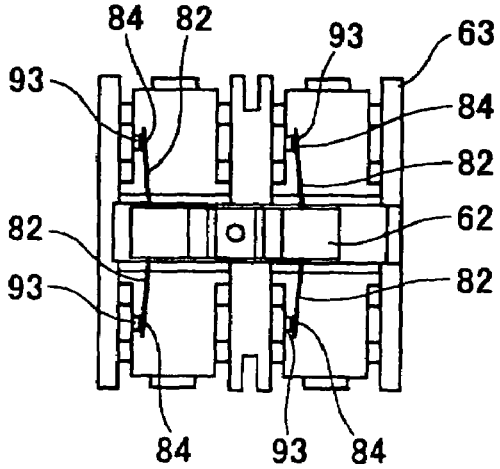

On the side of the supplementary contact point block 3, the guide 62 is also in the returned condition as shown in FIG. 19A when the guide 21 on the side of the relay main body F is in the returned condition and the mobile contact points 84 of each contact member 82 are separated from the fixed contact points 93. As the coil 15 of the electromagnetic block 11 is excited and the guide 21 is moved by the pulling force F against the biasing force of the returning spring 23 through the iron member 12, the upward protrusion 29 of the guide 21 interferes with the leg parts 72 of the guide 21 and causes the guide 62 to move as shown in FIGS. 19B and 19C and hence the mobile contact points 84 of the contact member 82 come to contact the fixed contact points 93.

Figure 20:
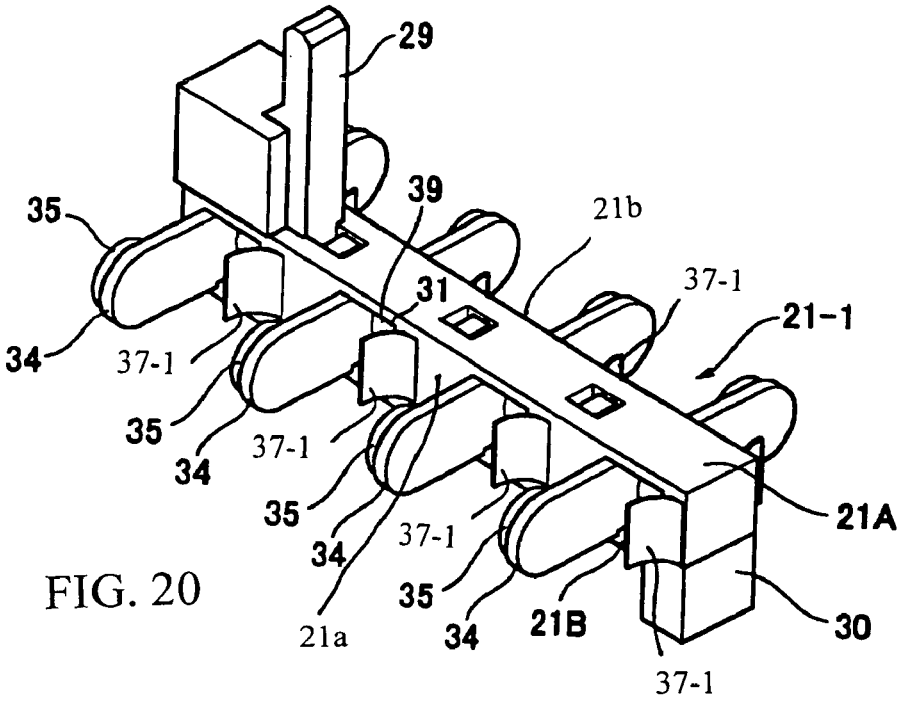
FIG. 20 is a diagonal view of another contact point contact mechanism for the guide.

FIG. 20 shows another guide 21-1 embodying this invention. This guide 21-1 is different from the guide 21 described above in that elastically deformable parts 37-1 having the shape of a gradually curving plate spring are provided to each of the side surface parts 21*a* and 21*b* of the upper main body 21A instead of the protruding contact part 33. As shown in FIG. 20, each of these elastically deformable parts 37-1 is tilted towards the corresponding contact member 34. In this embodiment of the invention, these elastically deformable parts 37-1 serve as load generating means of this invention. In other respects, the guide 21-1 is structured in the same way as the guide 21 described above. Thus, like or equivalent components in FIG. 20 are indicated by the same numerals as before and are not explained repetitiously.

In the above, there is no supplementary member 36 attached to the contact member 34. The mobile contact points 35 are attached to both end parts of the contact member 34. With this example, the contact member 34 is inserted into the inserting parts 31 and the contact point spring 39 is contained inside the spring containing part 32. The contact member 34 is biased by the contact point spring 39.

If the guide 21-1 according to the second embodiment of the invention described above is put inside the contact point block 2 instead of the guide 21 according to the first embodiment of the invention, as the guide 21-1 is moved against the returning spring 23, its elastically deformable parts 37-1 come to contact the contact members 34 and the elastically deformable parts 37-1 become deformed by assuming a gradually curving configuration and thereby generating a spring load F3. This is the completely adsorbed condition referred to above, and the contact point pressure due to both the contact point spring load F2 and the spring load F3 generated in the elastically deformable parts 37-1 operates on the contact members 34 to compress the mobile contact points 35 onto the fixed contact points 48.

Thus, in the completely adsorbed condition, the contact point spring load F2 and the spring load F3 generated in the elastically deformable parts 37-1 are applied as the contact point pressure. In this case, too, since the spring load F3 is generated immediately before the mobile contact points 35 contact the fixed contact points 48, it is not necessary to obtain a large contact point pressure by increasing the load of the contact point spring 39 by increasing the power consumption for the coil 15. In other words, a sufficient contact point pressure can be obtained without increasing the power from the coil 15. In this example, too, it is preferable to form the elastically deformable parts 37-1 with a metallic material such as copper such that heat from the contact members can be effectively irradiated.

Figure 21:
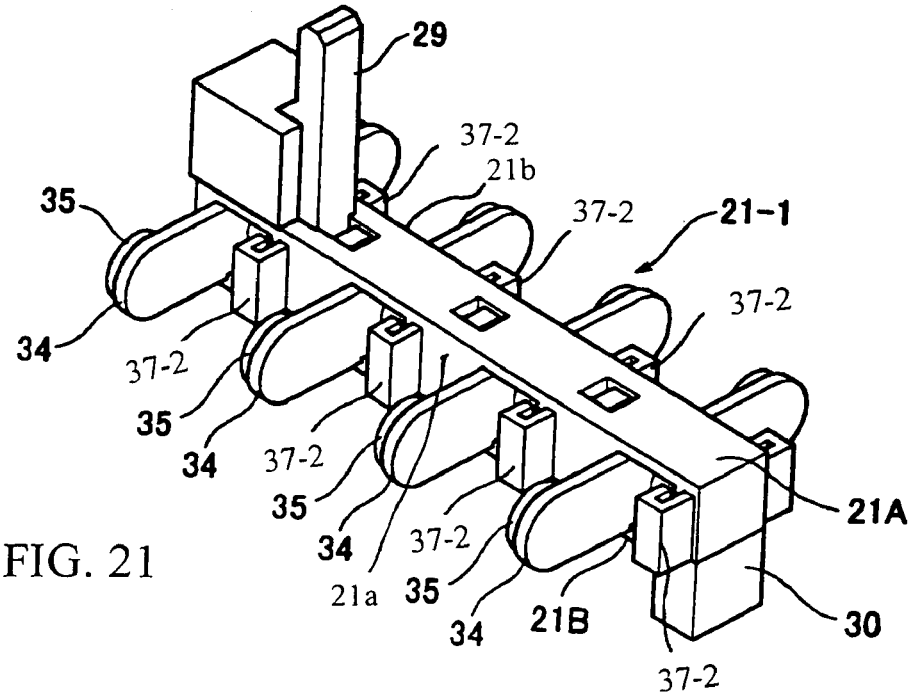
FIG. 21 is a diagonal view of still another contact point contact mechanism for the guide.

The elastically deformable parts 37-1 shown in FIG. 20 may be replaced by equally deformable members, or sectionally U-shaped parts 37-2 as shown in FIG. 21, produces so as to have the shape of an elongated planar material folded twice at both end parts each time approximately by 90° such that the material is altogether bent approximately by 180°, provided to both side surfaces 21*a* and 21*b* of the upper main body 21A. In this case, these sectionally U-shaped elastically deformable parts 37-2 serve as the load generating means of this invention. It goes without saying that they also have similar functions as the gradually curved elastically deformable part 37-1 shown in FIG. 20.

Figure 22:
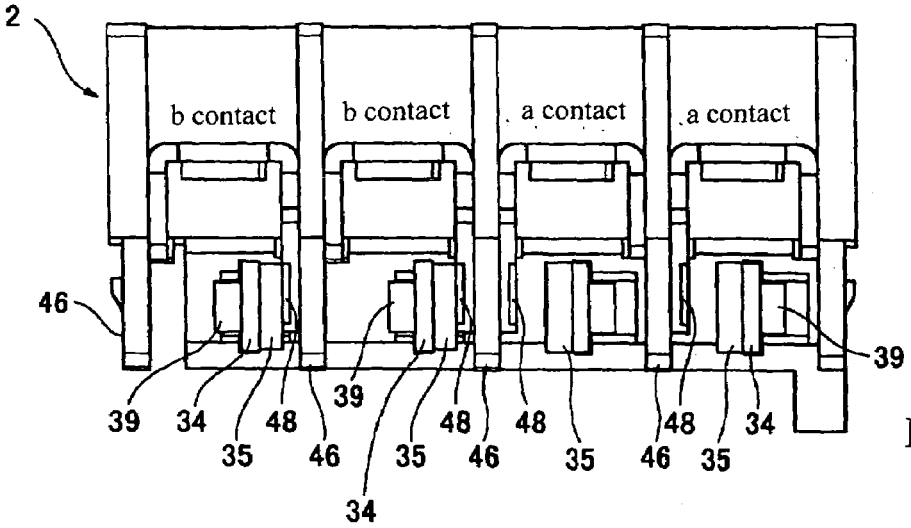
FIG. 22 is a diagram for explaining another contact point structure.
Figure 23:
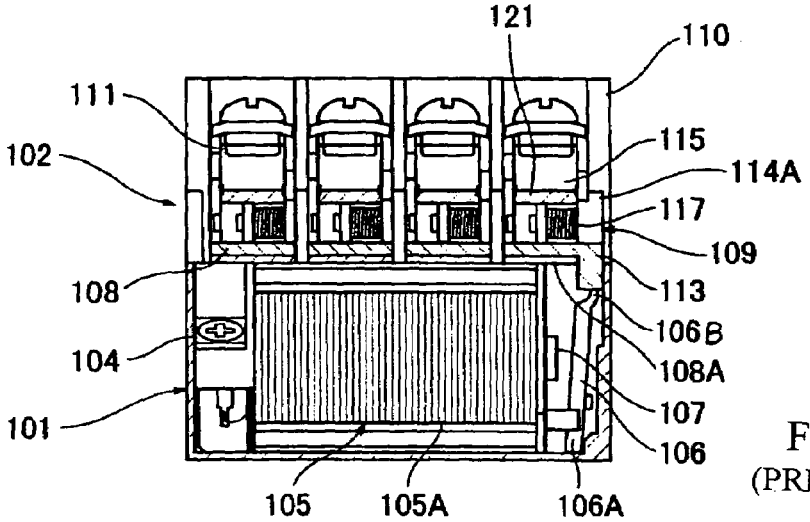
FIG. 23 (PRIOR ART)
FIG. 23 is a vertical sectional view of a prior art electromagnetic relay.
Figure 24:
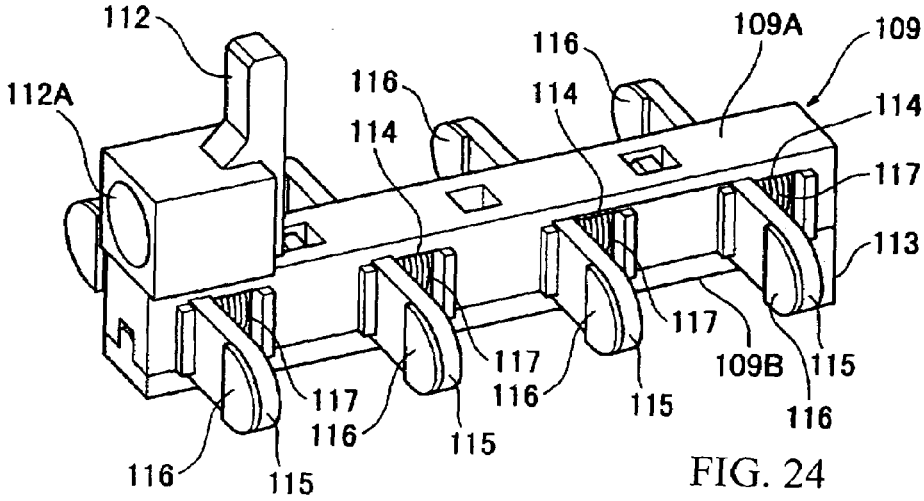
FIG. 24 (PRIOR ART)
FIG. 24 is a diagonal view of a guide in the prior art electromagnetic relay of FIG. 23.
Figure 25A:
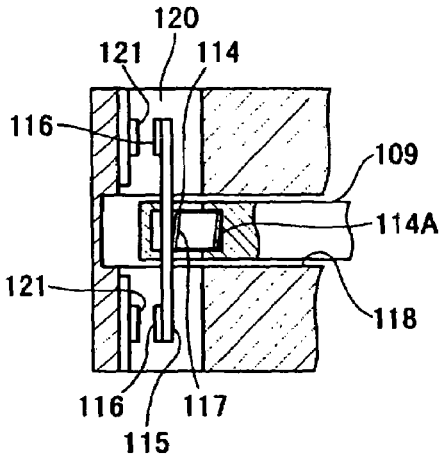
FIG. 25A (PRIOR ART)
FIGS. 25A and 25B are sectional views of a portion of the prior art electromagnetic relay of FIG. 23 for explaining its operation.
Figure 25B:
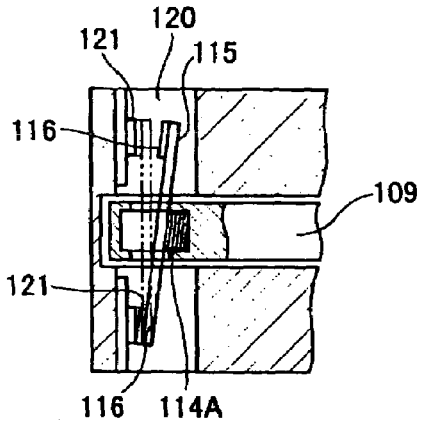
FIG. 25B (PRIOR ART)
Figure 26:
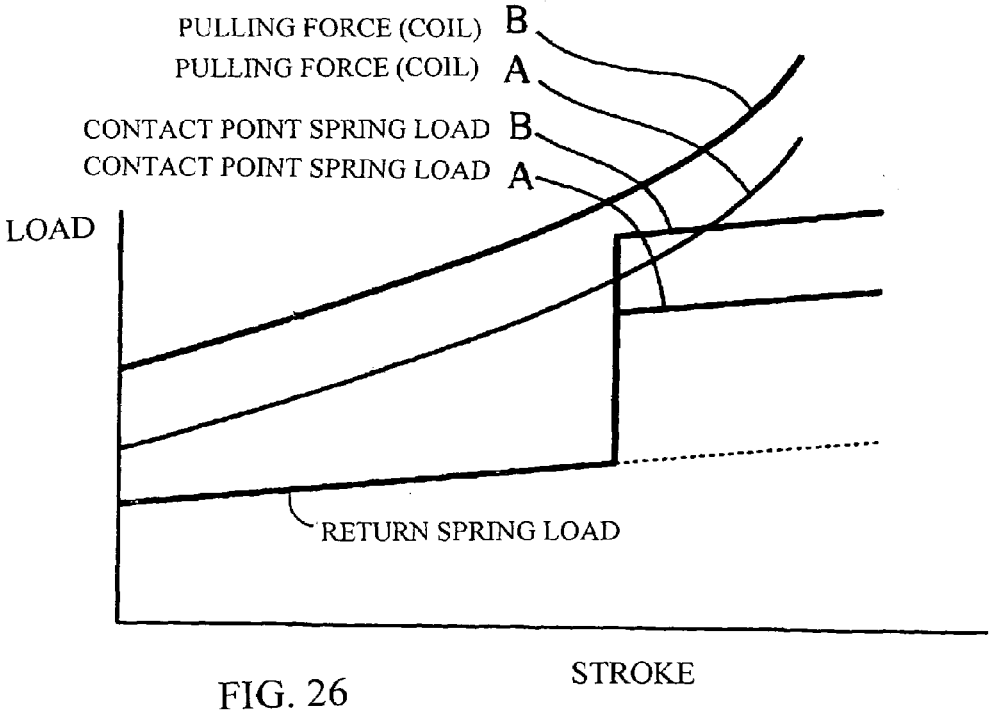
FIG. 26 (PRIOR ART)
FIG. 26 is a schematic graph for the characteristic of the prior art electromagnetic relay of FIG. 23.

Other variations are possible within the scope of this invention. Although the invention has been described above for so-called a-contact points (separating the mobile contact points 35 from the fixed contact points 48 in the returned condition by biasing the contact member 34 by the contact point spring 39 in the direction of the fixed contact point 48), this is not intended to limit the scope of the invention. FIG. 22 shows, for example, two b-contact point structures (having the mobile contact points 35 contacting the fixed contact points 48 in the returned condition) on the left-hand side and two a-contact point structures on the right-hand side.

In summary, the electromagnetic relays according to this invention supply a contact point pressure from both a contact point spring load and a load generated by load generating means and since this load is generated before the mobile contact point comes to completely contact the fixed contact point, it is not necessary to provide the contact point pressure by increasing the power consumed by the coil to increase the load of the contact point spring for limiting the rise in temperature due to a current.

What is claimed is:

1. An electromagnetic relay comprising:

a contact member having a mobile contact point;

a fixed contact point;

a contact point spring that applies a biasing force on said contact member towards said fixed contact point;

a guide that carries said contact member and said contact point spring;

a coil that generates a pulling force when excited to move said guide;

a returning spring that provides a biasing force and thereby causes said guide to return; and a load generating mechanism that generates a load on said contact member by the motion of said guide towards said fixed contact point against said returning spring immediately before said mobile contact point contacts said fixed contact point;

wherein said load generating mechanism applies a contact point spring load of said contact point spring and said load as a contact pressure to said contact member for pressing said mobile contact point onto said fixed contact point.

2. The electromagnetic relay of claim 1 wherein said load generating mechanism comprises a supplementary member having elastically deformable folded end parts on both ends, said supplementary member being attached to said contact member, said guide having protruding contact parts that cause said folded end parts to be deformed to thereby generate said load by contacting said folded end parts as said guide is moved.

3. The electromagnetic relay of claim 2 wherein said supplementary member is made of a metallic material.

4. The electromagnetic relay of claim 1 wherein said load generating mechanism comprises spring-forming members that are attached to said guide and are adapted to become deformed and to thereby generate said load by contacting said contact member as said guide is moved.

5. The electromagnetic relay of claim 4 wherein said load generating mechanism comprises elastically deformable members that are attached to said guide and are adapted to curve gradually when deformed, thereby generating said load by contacting said contact member as said guide is moved.

6. The electromagnetic relay of claim 4 wherein said load generating mechanism comprises folded members each of which is attached to said guide and has elastically deformable folded end parts on both ends adapted to be deformed to thereby generate said load by contacting said contact member as said guide is moved.

7. The electromagnetic relay of claim 5 wherein said elastically deformable members comprise a metallic material.

8. The electromagnetic relay of claim 6 wherein said folded members comprise a metallic material.

* * * * *